United States Patent [19]

Pekny

[11] Patent Number: 4,823,721

[45] Date of Patent: Apr. 25, 1989

[54] MARINE ANCHOR

[76] Inventor: Robert E. Pekny, 355 53rd St., N., St. Petersburg, Fla. 33710

[21] Appl. No.: 148,559

[22] Filed: Jan. 26, 1988

[51] Int. Cl.[4] ..... B63B 21/46

[52] U.S. Cl. ..... 114/303; 114/302

[58] Field of Search ..... 114/294, 307, 297–304

[56] References Cited

U.S. PATENT DOCUMENTS

| | | | |
|---|---|---|---|
| 1,583,795 | 5/1926 | Pasturzak | 114/303 |
| 2,490,583 | 12/1949 | Dunkelberger | 114/303 |
| 2,526,214 | 10/1950 | Faraone | 114/303 |
| 2,643,630 | 6/1953 | Buck | 114/303 |
| 2,741,209 | 4/1956 | Reckendorf | 114/303 |
| 3,754,525 | 5/1973 | Leighty | 114/303 |
| 4,403,564 | 9/1983 | Garvin | 114/303 |

FOREIGN PATENT DOCUMENTS

| | | | |
|---|---|---|---|
| 2174346 | 11/1986 | United Kingdom | 114/303 |

*Primary Examiner*—Joseph F. Peters, Jr.
*Assistant Examiner*—Clifford T. Bartz

[57] ABSTRACT

An improved marine anchor that may be quickly assembled or disassembled from its component parts. The compactness of these parts allows for very convenient storage of the anchor when it is disassembled. When assembled, the anchor provides great strength and holding ability. Because the anchor is very quickly assembled, it is ideal for emergency situations. Since the flukes are removable, the user can select various numbers and shapes, interchanging them for various sea-bed conditions as appropriate.

1 Claim, 2 Drawing Sheets

MARINE ANCHOR

BACKGROUND

1. Field of Invention

This is an invention that relates to marine anchors. The object of this invention is to provide an anchor of high-holding power and great strength that can be disassembled to allow storage in small spaces, It is a further object of this invention that the assembly and disassembly shall not require any specialized skills or tools. While there is no limitation to the size of the anchor its primary function is to afford greater safety and simplicity to the smaller vessel.

2. Description of Prior Art

Previous stowable anchors were designed with their flukes in opposing pairs that were indexed onto the shank and pinned or bolted together. Approaches of this nature are seen in U.S. Pat. Nos. 2,359,538, 2,526,214, 2,735,395, 2,741,209, and 3,285,218. These systems had the drawbacks of requiring the user to replace bent cotter pins whenever the anchor was used or to take apart threaded fasteners that had been subject to the mud and grit of the sea-bed. They also had very flat flukes that were not designed to bury in a mud or sand bottom. This made them useful mainly on rocky bottoms where their straight style flukes may have been able to hook on the sea-bed instead of bury in it. They did not have any provisions to allow them to be released from the sea-bed if their flukes became lodged or wedged under a snag. These were shortcomings that limited their usefulness.

OBJECTS AND ADVANTAGES

The object of this invention is to provide an anchor of great strength and holding power that can be disassembled quickly and easily into its component parts for easy storage. As shall be seen there are a limited number of component parts that may be stored independently or together in a very compact configuration. The anchor is held together in a very simple manner to allow quick assembly in an emergency. The anchor, once assembled, has no "weak-links" or sophisticated mechanisms which can be damaged by fouling, impact or corrosion encountered in the marine environment. Because different sea-bed conditions are often encountered, the same basic anchor assembly may be modified by using flukes of a different shape. For example, in a soft muddy bottom, broader flukes with more area would provide more holding power than the standard sized flukes. This same advantage could be obtained by putting on a larger number of the same sized flukes. A further major advantage is the optional anchor cable/line attachment point on the anchor end plate. The anchor cable/line may be attached at this point, then passed along side of the anchor shank and then attached to the normal shackle with a piece of breakable string or a breakable wire tie. The anchor line/cable is not passed through the standard shackle. In the event the anchor flukes become wedged under a snag of some sort on the bottom, the breakable tie can be snapped allowing the anchor to be pulled out backwards from under the snag.

DRAWING FIGURES AND REFERENCE NUMERALS

Figure 1:
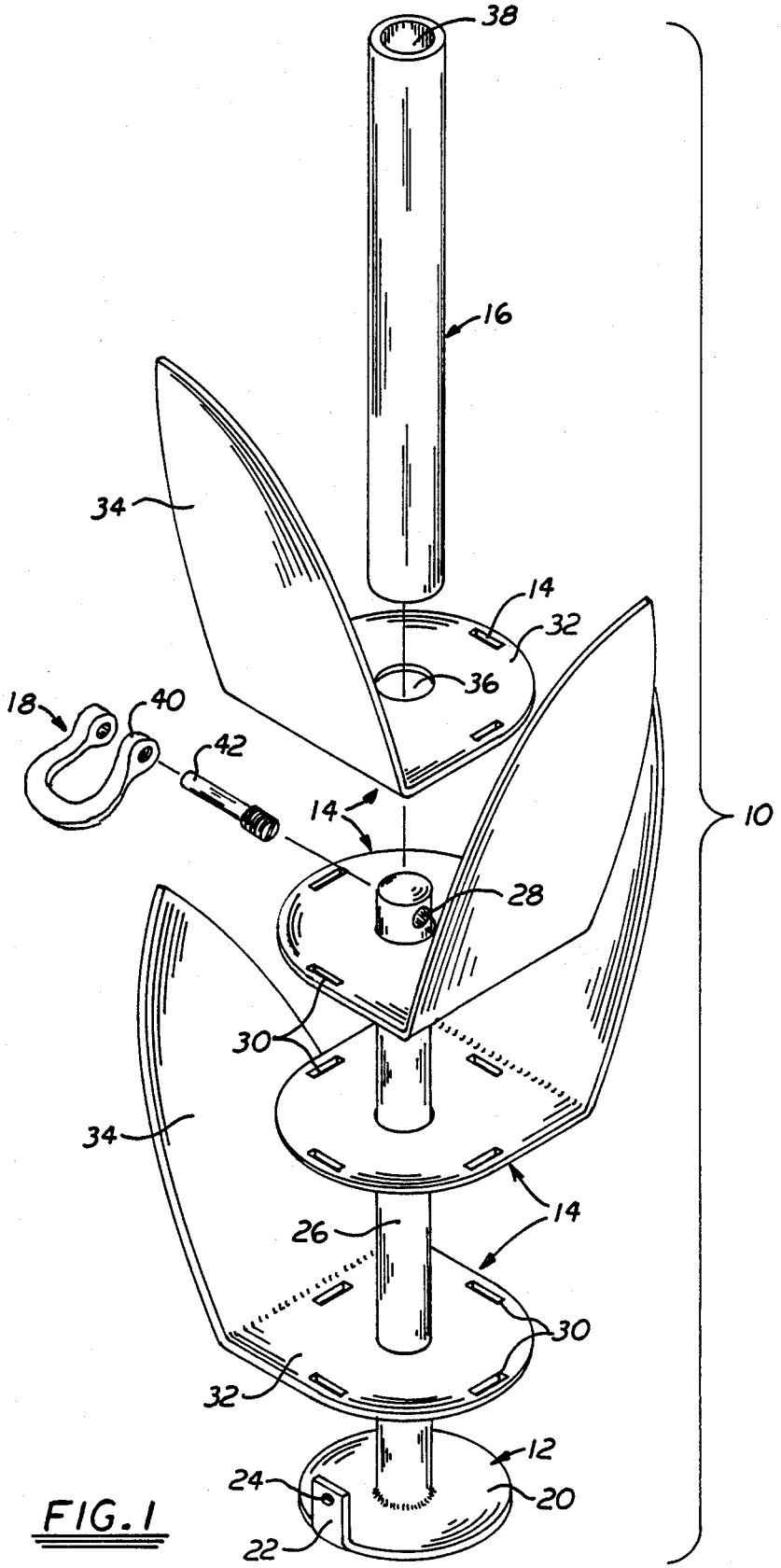
FIG. 1 is an exploded view of the invention showing the component parts of the anchor relative to their assembled position.
Figure 2:
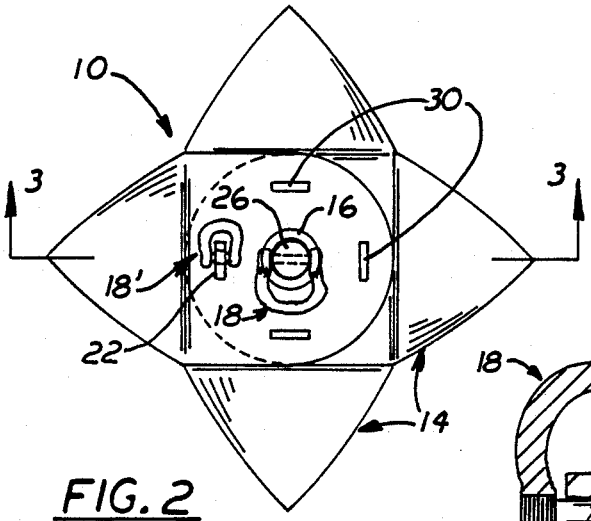
FIG. 2 is a top view of the assembled anchor.
Figure 3:
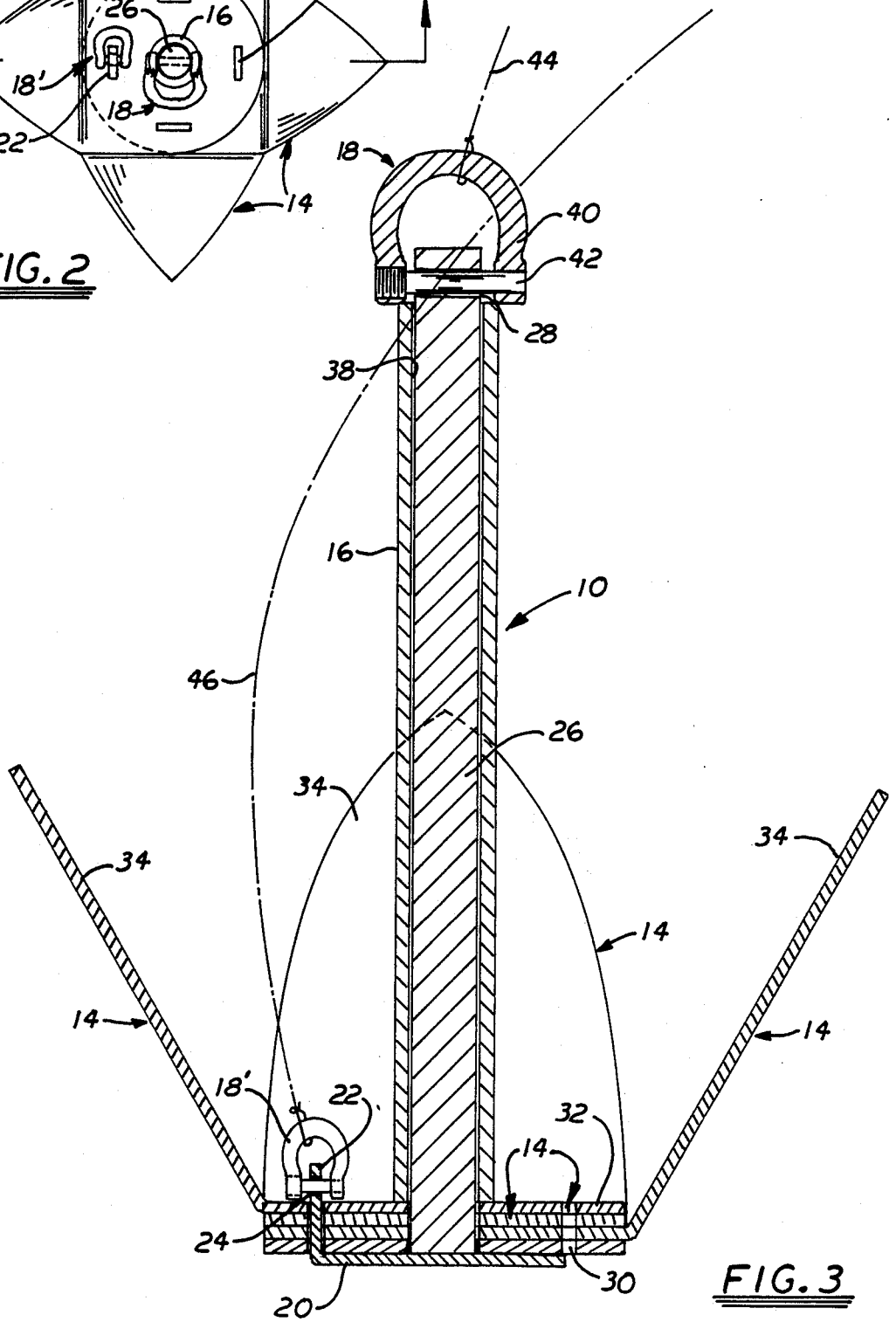
FIG. 3 is a cross-section of the assembled anchor as if cut by lines 3 in FIG. 2.

Number 10 is the anchor assembly.

Number 12 is the anchor shank sub-assembly.

Number 14 is the fluke of which there could be 3 or more.

Number 16 is the locking tube.

Number 18 is the shackle.

Number 18' is the shackle for the optional anchor line/cable (46).

Number 20 is the end plate of the shank sub-assembly (12).

Number 22 is the plate extension of the shank sub-assembly (12).

Number 24 is the through-hole for the shackle (18').

Number 26 is the shank bar of the shank sub-assembly (12).

Number 28 is the shackle through-hole in the shank bar.

Number 30 is the fluke hole/notch.

Number 32 is the bottom end of the fluke.

Number 34 is the upper burying/hooking end of fluke.

Number 36 is fluke shank-hole.

Number 38 is the tube opening of the locking tube (16).

Number 40 is the bale of the shackle.

Number 42 is the shackle locking pin.

Number 44 is the anchor line/cable.

Number 46 is the anchor line/cable in its optional position.

DESCRIPTION

The anchor shank (12) has a shank bar (26) which has at its head a shackle through-hole (28) for the attachment of a shackle (18) which serves to lock down the locking tube (16) and also serves as an attachment point for the anchor line or cable (44). At the opposite end of the anchor shank (12) is an end plate (20) from which projects a plate extension (22). The plate extension (22) is used as an optional attachment point for the anchor cable (46) and as a means of indexing the flukes (14).

The flukes (14) are indexed on the plate extension (22) by placing the fluke shank hole (36) of the fluke (14) over the shank bar (26) and the alignment of the fluke hole/notch (30) over the plate extension (22). The flukes (14) once indexed over the plate extension (22) are held in place by the locking tube (16) by inserting the shank bar (26) into the tube opening (38) of the locking tube (16) and holding down the locking tube (16) by the insertion of the shackle pin (42) through the hole in the shackle (18) and the through-hole (28) in the shank bar (26). After the attachment of an anchor line/-cable (44) to the shackle (18) the now assembled anchor is ready for use. When using the optional anchor cable/-line (46), it is attached to shackle (18') which is attached to through-hole (24) in the plate extension (22). The anchor cable/line (46) is then passed along-side the locking tube (16) and attached to the shackle (18) with a piece of breakable string or a breakable wire tie. The anchor line/cable (46) is not passed through shackle (18). In the event the anchor flukes (14) become wedged under a snag on the bottom, the breakable tie can be broken allowing the anchor to be pulled out backwards from under the snag.

In order to disassemble the anchor it is only necessary to remove the shackles (18,18') from the shank bar (26) and the plate extension (22) thus releasing the locking tube (16) which in turn releases the flukes (14) so they may be removed and the anchor is now ready for storage.

It can be seen from this description that the process described and the components used would be feasible for any weight of anchor and provide quick assembly with great strength and ground-holding ability. While the above description contains many specifics, these should not be construed as limitations on the scope of the invention, but as one preferred embodiment thereof. Those skilled in the art will be able to envision several other possible variations. A skilled artisan could change the number or shape of the flukes (14) without adversely affecting the function of the anchor. The method of indexing the flukes (22) and locking them down (16) as shown is but one of several ways that this could be done.

The anchor may be constructed of several different materials. A variety of construction methods may also be used including weldments, castings, or a combination thereof. As such, the reader is requested to determine the scope of the invention by the included claim and its legal equivalent, and not solely by the examples which have been given.

I claim:

1. A marine anchor assembled of its component parts comprising:

a. a unitary structure consisting of a vertical shank with a fixed end plate on one end;

b. said end plate having a projection generally parallel to, but not in line with, said shank;

c. multiple flukes;

d. said projection used as a means for radially fixing said flukes about said vertical shank;

e. said flukes having apertures mating with said projection;

f. said flukes, after being mated with said projection on said end plate, being demountably attached;

g. by a conveniently removable locking device, whereby an anchor of great strength and holding power is quickly assembled from its compact and easily stowable component parts.

* * * * *